United States Patent [19]

Merrell

[11] 4,295,640

[45] Oct. 20, 1981

[54] JEWELER'S TOOL

[76] Inventor: Charles E. Merrell, 6318 SE. Aldercrest, Milwaukie, Oreg. 97222

[21] Appl. No.: 109,843

[22] Filed: Jan. 7, 1980

[51] Int. Cl.[3] ..... B23Q 1/00

[52] U.S. Cl. ..... 269/47; 269/76; 29/160.6

[58] Field of Search ..... 269/97, 76, 287; 29/10, 29/160.6

[56] References Cited

U.S. PATENT DOCUMENTS 263,035 8/1882 Fellinger ..... 269/287 X

*Primary Examiner*—Robert C. Watson

*Attorney, Agent, or Firm*—Klarquist, Sparkman, Campbell, Leigh, Whinston & Dellett

[57] ABSTRACT

Mandrels for ring working and bracelet working are rigidly supported by a specially adapted mandrel holder secured to a supporting base. A chucking opening is provided in the holder for receiving the mandrel and a fastener is provided for securing the mandrel to the holder. The fastener is adjustable to permit a ring mandrel to be positioned so that selected working positions on the mandrel can be disposed in close proximity to the holder.

4 Claims, 5 Drawing Figures

JEWELER'S TOOL

The present invention pertains generally to jeweler's tools and more particularly to mandrels and related tools employed in the silver and gold crafts for working with rings, bracelets and the like.

It has been a practice in the prior art to employ ring mandrels which are tapered or have stepped cylindrical surfaces to accommodate rings of different sizes at respective working positions on the mandrel. Typically, such mandrels are about twelve inches long and have steps progressively increasing in diameter from three-eighths inch at the small end to fifteen-sixteeths inch at the large end. A shank is usually provided at the large end of the mandrel for insertion into a holder for securing the mandrel during ring working operations.

Heretofore a disadvantage of such tools has been the tendency of the mandrel to flex and bounce in the holder particularly when the craftsman shapes a ring by repetitively pounding and striking it in a manner well known to those skilled in the art. It will be appreciated that this flexing effect becomes progressively more pronounced the more the working position is removed from the holder. The problem is most severe at the small end of the mandrel at which most of the impact delivered to the ring will typically be absorbed by the movement of the mandrel, thus reducing the shaping effect of each impact to the ring.

One solution to the aforementioned problem is to provide several mandrels of shortened length so that the distance from the smallest ring working position to the holder is only several inches, thus minimizing the effect of mandrel flexing. It will be recognized that another approach to the problem which would substantially eliminate the effect of mandrel flexing would be to provide one short mandrel for each ring size so that the impacts of ring working will always be applied adjacent to the holder.

It would be desirable, however, to provide a solution to the aforementioned problem of mandrel flexing without employing more than one mandrel. This objective is accomplished in accordance with one important feature of the invention herein disclosed by the provision of a jeweler's tool which is adaptable to secure a mandrel at selected positions relative to a mandrel holder so that working positions of different diameters on the mandrel can be positioned in close proximity to the holder.

Another disadvantage of prior art jeweler's tools is that they tend to be very specially adapted to particular operations. It would therefore be desirable to provide a more versatile tool useful for more than a single operation. This object is accomplished in accordance with another important feature of the invention herein disclosed by the provision of a jeweler's tool which is adaptable to secure either a ring mandrel of circular cross-section or a bracelet mandrel of an oval-shaped cross-section by means of a single mandrel holding mechanism.

The presently preferred way of carrying out the aforementioned and other objectives of the present invention will now be described in detail with reference to the accompanying drawings, in which.

Figure 1:
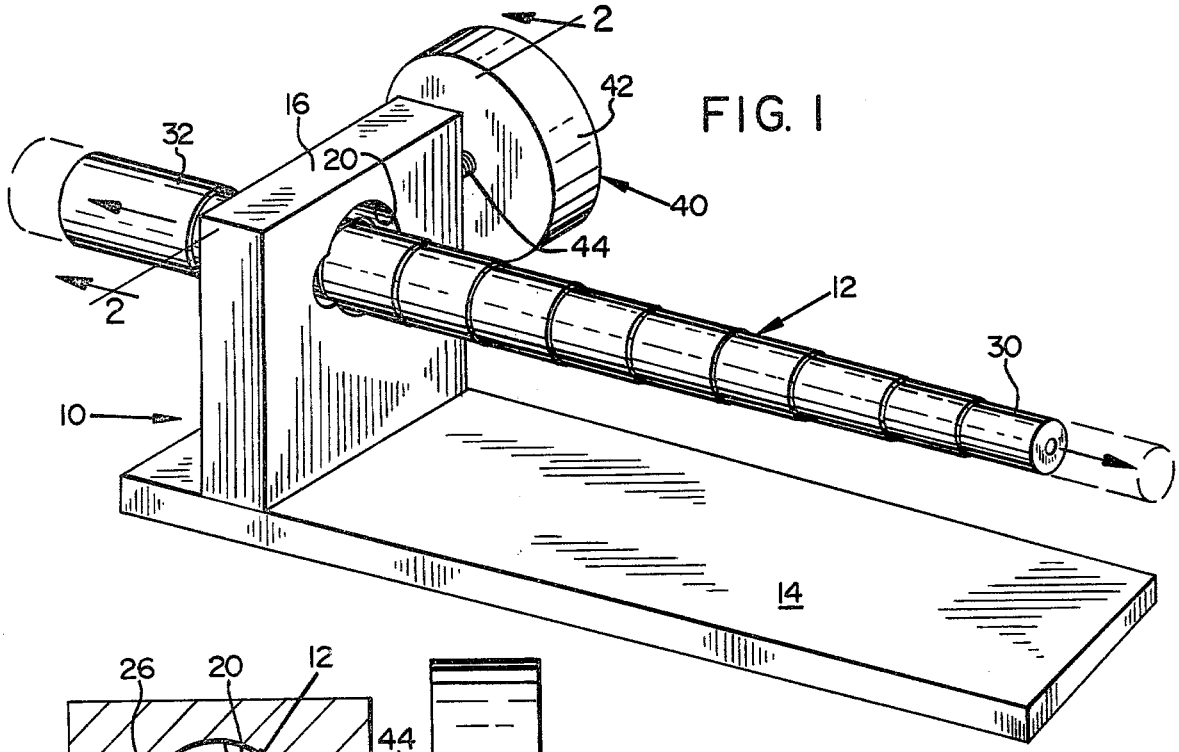
FIG. 1 is a perspective view of a jeweler's tool in accordance with the present invention shown with a ring mandrel secured therein.
Figure 2:
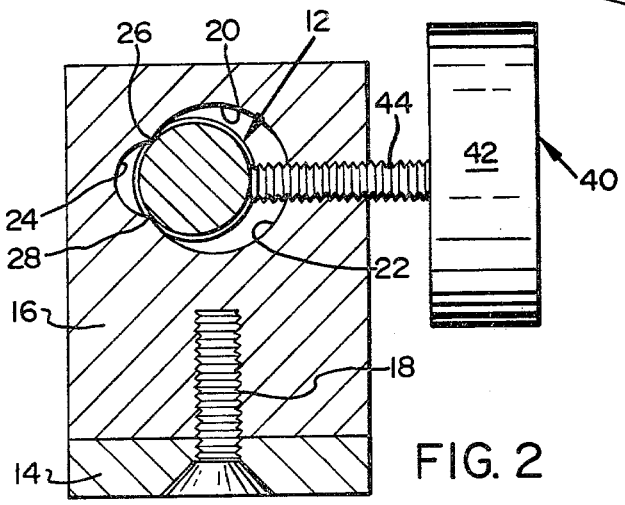
FIG. 2 is a vertical cross-section taken along the line 2—2 of FIG. 1.

Referring now to the figures, a jeweler's tool is illustrated and designated generally by reference numeral 10. With particular reference to FIGS. 1 and 2, the jeweler's tool is shown in the manner in which it is employed with a ring mandrel 12 of essentially conventional construction having a plurality of working positions disposed in stepped fashion along the length thereof. Each working position has a cylindrical surface of about one inch in length with a given diameter corresponding to a particular ring size. Inasmuch as the ring mandrel is essentially conventional, the number and sizes of ring working positions will not be described in detail. It will be appreciated, however, that various different ring mandrels from that specifically illustrated herein have useful application to the present invention. For example, the present invention also contemplates the use of a continuously tapered ring mandrel (not shown).

Figure 3:
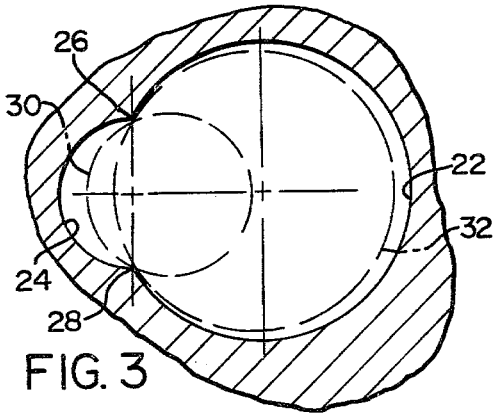
FIG. 3 is a graphic illustration showing the center lines of cylindrical bores useful for explaining the structure of the tool of FIGS. 1 and 2.

The jeweler's tool 10 includes a supporting base 14 to which a mandrel holder 16 is rigidly secured, such as by means of the threaded stud 18 seen in FIG. 2. The holder 16 is provided with a chucking opening 20 at a convenient distance from the base 14. The chucking opening 20 is formed by two intersecting eccentric cylindrical bores 22 and 24, which are graphically depicted in FIG. 3. The bores 22 and 24 intersect to define gripping edges 26 and 28, which preferably lie in a plane which includes the center of the smaller cylindrical bore 24.

Referring again to FIG. 1, the mandrel 12 includes a working position 30 of smallest diameter at one end thereof and a working position 32 of largest diameter at the other end thereof. (It will be appreciated that the position 32 might alternatively serve as a shank and the adjacent cylindrical surface would then serve as the largest ring working position.) The positions that the mandrel 12 would assume when the largest and smallest ring working positions are disposed within the holder 16 is illustrated by the dashed outlines 30 and 32 in FIG. 3.

It will be appreciated that the larger bore 22 has a diameter which is greater than the diameter of the largest ring working position 32. A bore with a diameter of 0.965 inch is suitable for most purposes as jeweler's mandrels typically have a shank with a diameter between 0.875 and 0.955 inch and a largest ring working position of 0.945 inch. The smaller bore 24 has a diameter which is less than the diameter of the smallest ring working position to be disposed within the holder 16. By using bores of such sizes, the gripping edges 26 and 28 will be located effectively to bite into corresponding surface portions of any desired working position of the mandrel 12. A smaller bore of 0.5 inch is suitable for most standard ring mandrels.

In order to force the mandrel 12 against the gripping edges 26 and 28, an adjustable fastener 40 is provided as will now be described with particular reference to FIG. 2. The fastener 40 includes a cylindrical head or nob 42 and a threaded stud 44 extending axially from the nob 42 as shown. The threaded stud 44 passes through a correspondingly threaded hole in a side wall of the holder 16. The stud 44 passes into the opening 20 in alignment with the centers of the bores 22 and 24 so that by appropriate rotation of the nob 42 the end of the stud will engage the mandrel 12 and force it against the gripping edges 26 and 28 in the manner indicated.

From the foregoing description of the jeweler's tool 10 as applied with the ring mandrel 12, it will be appreciated that any selected working position upon the ring mandrel 12 can be disposed either adjacent to or within several positions in proximity to the holder 16 so that ring working operations on the selected position can be done with a minimum of mandrel bounce or flexing.

It should be noted that the amount of mandrel flexing and bounce can be further minimized by clamping the base 14 to a rigid supporting table. However, the tool 10 is adaptable so that ring working operations can proceed without securing the base 14 in such a fashion since the base 14 and holder 16 are provided with sufficient mass to absorb the normal impact applied during ring working operations. Preferably the base 14 will have sufficient mass and hardness that its smooth upper surface can be used as a jeweler's anvil.

Figure 4:
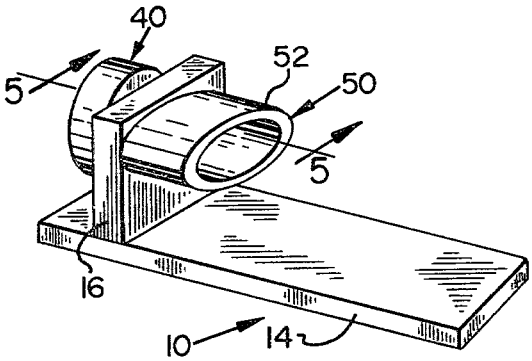
FIG. 4 is a perspective view of the jeweler's tool of FIG. 1 but shown with a bracelet mandrel secured therein.

Now referring to FIGS. 4 and 5, an adaptation of the jeweler's tool 10 for use with a bracelet mandrel 50 will be described. The bracelet mandrel 50 has a single oval-shaped working surface 52. At one end of the mandrel 50 is a peripheral wall 54 from which a cylindrical shank 56 extends outwardly. The shank 56 has a diameter slightly smaller than the diameter of the large cylindrical bore 22 so that the shank 56 will snugly fit into the chucking opening 20. The shank 56 defines a threaded axial opening to receive the threaded stud 44 of the fastener 40 in the manner shown.

Figure 5:
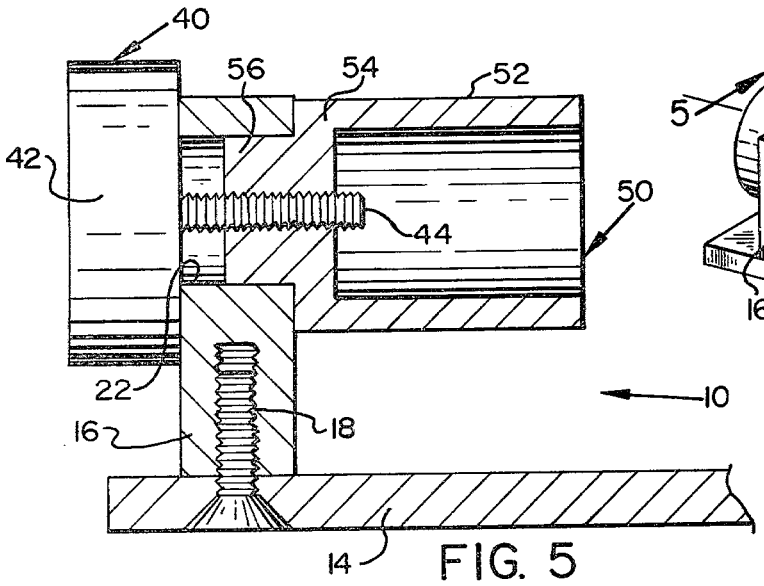
FIG. 5 is a vertical cross-section taken along line 5—5 of FIG. 4.

Accordingly, the bracelet mandrel 50 can be rigidly secured to the holder 16 by tightening down the fastener 40 until the head 42 tightly abuts one surface of the holder and the peripheral wall 54 tightly abuts the opposite surface thereof as depicted in FIG. 5. It will, of course, be appreciated that the orientation of the working surface 52 of the mandrel 50 can be varied simply by loosening the fastener 40, making an adjustment to the position of the mandrel 50 and then retightening the fastener 40 to once again secure the mandrel 50 rigidly in place.

Although a preferred embodiment of the invention and two specific applications thereof have been described in detail, it will be understood that various modifications, substitutions and alternatives are within the spirit and scope of the invention as defined by the appended claims. For example, the jeweler's tool of the present invention can be used to secure a variety of mandrels and jeweler's implements other than those illustrated.

What is claimed is:

1. A jeweler's kit comprising:

a base;

a mandrel holder rigidly securable to the base, the holder including walls defining an opening for receiving a mandrel, one wall of the holder including a threaded hole extending therethrough into the opening;

an elongated ring mandrel provided with a plurality of working positions having circular cross-sections of differing diameters, the ring mandrel being insertable into the opening in the holder and selectively positional therein to permit each working position to be disposed in close proximity to the holder with the mandrel secured therein;

a bracelet mandrel provided with an oval-shaped working surface and having a shank extending outward from the working surface, the shank being insertable into the opening of the holder to secure the mandrel to holder, the shank including a threaded hole in an end thereof;

a fastener having a head and a threaded stud affixed to the head, the stud of the fastener cooperating at one time with the threaded hole in the holder to permit the ring mandrel to be rigidly secured in selected positions by selectively clamping the mandrel within the opening by adjusting the extension of the stud into the opening, the stud of the fastener cooperating at another time with the threaded hole in the shank of the bracelet mandrel to permit the bracelet mandrel to be rigidly secured in the holder by turning the stud until the head of the fastener and a wall of the bracelet mandrel are clamped tightly against opposite sides of the holder.

2. A tool for supporting an elongated ring mandrel of the type having a plurality of working positions with circular cross-sections of different diameters axially aligned along the length of the mandrel, the tool comprising:

a supporting base;

a mandrel holder rigidly secured to the base, the holder having walls for carrying a ring mandrel in spaced relationship from the base, the walls having first and second spaced-apart gripping edges adapted to contact surface portions of the mandrel at each working position thereof when selectively positioned thereagainst; and a fastener for rigidly securing the ring mandrel against the walls of the holder in various axial positions to permit selected working positions to be disposed in close proximity to the holder, the fastener having a stud threadedly disposed in the holder perpendicular to the axis of the mandrel and being rotatably adjustable to bring the stud into contact with the mandrel to force the mandrel against the edges.

3. The tool of claim 2 wherein the gripping edges are defined by first and second eccentric intersecting cylindrical bores extending in the axial direction through the holder.

4. The tool of claim 3 wherein the diameter of the first bore is greater than the diameter of the largest working position on the mandrel and wherein the diameter of the second bore is less than the diameter of the smallest working position on the mandrel.

* * * * *